US005164872A

United States Patent [19]

Howell

[11] Patent Number: 5,164,872

[45] Date of Patent: Nov. 17, 1992

[54] LOAD CIRCUIT COMMUTATION CIRCUIT

[75] Inventor: Edward K. Howell, Simsbury, Conn.

[73] Assignee: General Electric Company, New York, N.Y.

[21] Appl. No.: 716,496

[22] Filed: Jun. 17, 1991

[51] Int. Cl.[5] ..... H01H 9/42

[52] U.S. Cl. ..... 361/3; 361/8; 361/11; 361/13

[58] Field of Search ..... 361/2, 3, 5, 6, 8-11, 361/13, 94, 97; 307/134, 135

[56] References Cited

U.S. PATENT DOCUMENTS

| | | | |
|---|---|---|---|
| 4,429,339 | 1/1984 | Jaeschke et al. | 361/94 |
| 4,631,621 | 12/1986 | Howell | 361/13 |
| 4,636,907 | 1/1987 | Howell | 361/13 |
| 4,644,309 | 2/1987 | Howell | 335/195 |
| 4,700,256 | 10/1987 | Howell | 361/13 |
| 4,723,187 | 2/1988 | Howell | 361/13 |

*Primary Examiner*—A. D. Pellinen
*Assistant Examiner*—S. Jackson
*Attorney, Agent, or Firm*—Richard A. Menelly

[57] ABSTRACT

Arrangement for arcless interruption of a-c load current in response to a current interruption command. Separable contact means serially connected with controlled impedance means, and parallel connected diversion means are intermediate the a-c source and the load. The controlled impedance comprises field effect transistors (FETs). Since FETs usually have only a single inherent junction, at least a pair of the FETs are oppositely poled so that load current can be cut off notwithstanding the direction of current flow when interruption is commanded. The pair of FETs may be connected back to back. An alternative embodiment has two branch circuits each comprising a FET and a separable contact means. Upon interruption load current is sequentially transferred from one to the other branch circuit and then to the diversion means.

7 Claims, 5 Drawing Sheets

LOAD CIRCUIT COMMUTATION CIRCUIT

BACKGROUND OF THE INVENTION

Applicant's U.S. Pat. No. 4,636,907, issued Jan. 13, 1987, entitled "Arcless Circuit Interrupter" in the name of E. K. Howell and assigned to the assignee of the subject application, is hereby incorporated by reference. The above referenced U.S. Patent relates to modifying, i.e. interrupting, load current flow in a first circuit that interconnects a source of electrical energy and a load circuit. Load current flowing through the first circuit is temporarily diverted to a second, i.e. diversion, circuit. Upon load current diversion, a switch in the first circuit can be rapidly opened under substantially zero current conditions and thus without arcing. Diversion of the load current prior to switch opening is accomplished by a controlled impedance circuit in the first circuit. The switch and the controlled impedance circuit are serially connected between the source of electrical energy and the load circuit, and the diversion circuit is connected in parallel with the series combination of the switch and the controlled impedance circuit. Various types of diversion circuits may be utilized for this purpose. Representative diversion circuits are, for example, disclosed in the following U.S. Patents which are in the name of E. K. Howell, the subject applicant, are assigned to the assignee of the subject application, and are hereby incorporated by reference: U.S. Pat. No. 4,700,256, issued Oct. 13, 1987 (which is a Continuation-In-Part of U.S. patent application Ser. No. 610,947 filed May 16, 1984 and since abandoned) entitled "Solid State Current Limiting Circuit Interrupter" and U.S. Pat. No. 4,631,621, issued Dec. 23, 1986, entitled Gate Turn Off Control Circuit".

Load current diversion to the diversion circuit is produced by the controlled impedance circuit. During normal operation, i.e., prior to diversion, the controlled impedance circuit essentially has a very low voltage drop and thus low power dissipation. Load current diversion results from a control signal which effectively increases the voltage drop across the controlled impedance circuit. This voltage causes the transfer of the load current and of energy stored in the inductive components of the first circuit to the diversion circuit. This is, for example, further described in U.S. Pat. No. 4,723,187, issued Feb. 2, 1988, entitled "Current Commutation Circuit", which is also in the name of E. K. Howell, is assigned to the assignee of the subject application, and is also incorporated herein by reference.

Controlled impedance circuits used for load current diversion must meet various requirements. When switched to their high impedance state, load current flow must produce a voltage drop that is sufficient to transfer current and stored energy at a sufficiently high rate.

While operating in their normal low impedance state, i.e. prior to diversion, load current must flow through the controlled impedance circuit with minimal power dissipation. U.S. Pat. No. 4,636,907, issued Jan. 13, 1987, discloses, for example, controlled impedance circuits comprising a switchable solid state device whose main electrodes are connected in circuit with the switch, source of electric energy and the load circuit. During normal operation, the solid state device is turned on so as to operate in saturation. When diversion is commanded, a control signal switches the solid state device to a high impedance, i.e. OFF state, so as to produce a voltage drop across the main electrodes. Particularly with large load currents, it is vital that the switch exhibits in its ON state an extremely low voltage drop and thus extremely low power dissipation. However, many types of solid state devices, e.g. certain types of thyristor structures and bipolar transistors, exhibit significant junction voltage drops in their ON state. With large load currents, this can produce substantial power dissipation.

A further requirement applies to arrangements for diverting a-c, as opposed to d-c, load currents. When a-c load currents are to be diverted, the controlled impedance circuit must be capable of being switched to its OFF state during either half-cycle, i.e. polarity, of the load current and source potential. If the controlled impedance circuit comprises a switchable solid state device whose main electrodes are connected in circuit between source and load, the solid state device must be capable of bilateral operation. Specifically, it must be capable of being switched OFF despite polarity reversals across its main electrodes. However, many types of solid state switches, e.g. certain thyristors, bipolar transistors and field effect devices, do not exhibit this type of bilateral operation.

U.S. Pat. No. 4,636,907, issued Jan. 13, 1987, also discloses an alternative embodiment for a-c load current diversion and interruption that satisfies the above recited requirements. This couples a-c load current via a transformer and bridge rectifier across the primary electrodes of bipolar transistors connected as a Darlington pair. The transformer has a primary in series with the switch of the load circuit and a secondary step up winding connected to the input of the bridge rectifier. When the bipolar transistors are gated to saturation conduction, the primary winding has an extremely low voltage drop. When the bipolar transistors are gated off, the voltage across the primary winding increases sufficiently to divert load current to the diversion circuit. The bridge rectifier provides a unilateral potential across the primary electrodes of the bipolar transistors. It thus compensates for any inability of the transistors to switch satisfactorily when a-c potential is directly applied across their primary electrodes. An adequate turns ratio of the transformer also assures that the primary winding has a sufficiently low voltage drop and power dissipation during normal operation, but a sufficiently high voltage drop for load current diversion in response to an interruption command. As subsequently described, the circuit including the bridge rectifier and bipolar transistors can have a substantial minimum voltage drop during saturation conduction. For these reasons, an adequate transformer step up ratio is required to maintain a sufficiently low voltage drop across the primary. Careful design is therefore required to also provide a sufficient voltage drop across the primary winding, when the transistors are cut off, to assure that load current is diverted. The relatively high voltage across the transformer secondary also requires use of solid state devices having a sufficiently high blocking voltage. Devices with a high blocking voltage may have relatively high voltage drops during saturation so as to require even more careful circuit design. Also, the use of power devices having a high blocking voltage, as well as the transformer, result in increased production costs.

OBJECTS OF THE INVENTION

It is an object of this invention to provide an improved arrangement for diverting and, if desired, for interrupting load currents of large magnitude.

It is a further object to provide such an improved arrangement that is capable of diverting and, if desired, for interrupting a-c and d-c currents.

It is a further object to provide such an arrangement that is capable of accomplishing the above recited objectives with minimal power dissipation.

It is yet a further object to provide such an arrangement that is simple and cost efficient.

It is another object to provide for the diversion of a-c current by means of an improved arrangement wherein solid state switching means are connected in series circuit between a source of electrical energy and a load circuit.

SUMMARY OF THE INVENTION

In accordance with one aspect of the invention, in a current interrupter useful for interrupting alternating current and of the type having serially connected separable contact means and controlled impedance means connected in parallel with current diversion means, the controlled impedance means comprises field effect transistors. Prior to load current interruption the FETs are in full conduction, so that there is a minimal voltage drop across the controlled impedance means. Interruption is initiated by decreasing FET conduction thus increasing the voltage drop across the controlled impedance means to divert load current prior to opening the separable contact means. Conventional field effect transistors, i.e. "FETs", have only a single inherent junction intermediate the source and drain electrodes and are only capable of blocking current flowing in one direction, i.e. capable of only unilateral but not bilateral current blocking.

To permit current interruption notwithstanding the instantaneous polarity of the source voltage and the direction of alternating load current, at least a pair of FETs are connected such that their source and drain electrodes are oppositely poled. Thus prior to interruption at least one FET conducts current from drain to source while at least one FET conducts current from source to drain. Control means responsive to a current interruption command vary the bias applied in circuit with the gate electrode of at least one of the pair of FETs to reduce conductivity between source and drain electrodes of at least one of the pair of FETs to increase the voltage drop across the controlled impedance means notwithstanding the instantaneous direction of load current flow.

The FETs may be connected back to back in a series circuit with the drain or source electrode of one FET being connected to a like electrode of another FET. These back to back connected FETs may be connected directly in series with the separable contact means. Alternatively they may be connected in a series loop circuit with the secondary winding of a transformer whose primary winding is connected serially with the separable contact means.

In another, advantageous, embodiment the oppositely poled FETs are serially connected, respectively, with first and second separable contact means to constitute first and second branch circuits connected in parallel with the current diversion means. Thus the branch circuits comprise first and second FETs serially connected, respectively, with first and second separable contact means. Responsive to a current interruption command, the control means causes the sequential transfer of load current from one of the branch circuits to the other and then to the current diversion means and also causes the sequential opening of the one and the other separable contact means. In the preferred embodiment, the direction of load current on occurrence of the initiation of the current is utilized to select the branch circuit from which load current is initially transferred. Specifically, the control means switches the bias of the one FET whose inherent junction is then forward poled so as to increase the potential between its drain and source electrodes and to transfer load current away from its branch circuit prior to opening its associated separable contact means. It then switches off the other FET whose inherent diode is then reverse poled to transfer its current to the current diversion means.

DETAILED DESCRIPTION OF THE INVENTION

Figure 1:
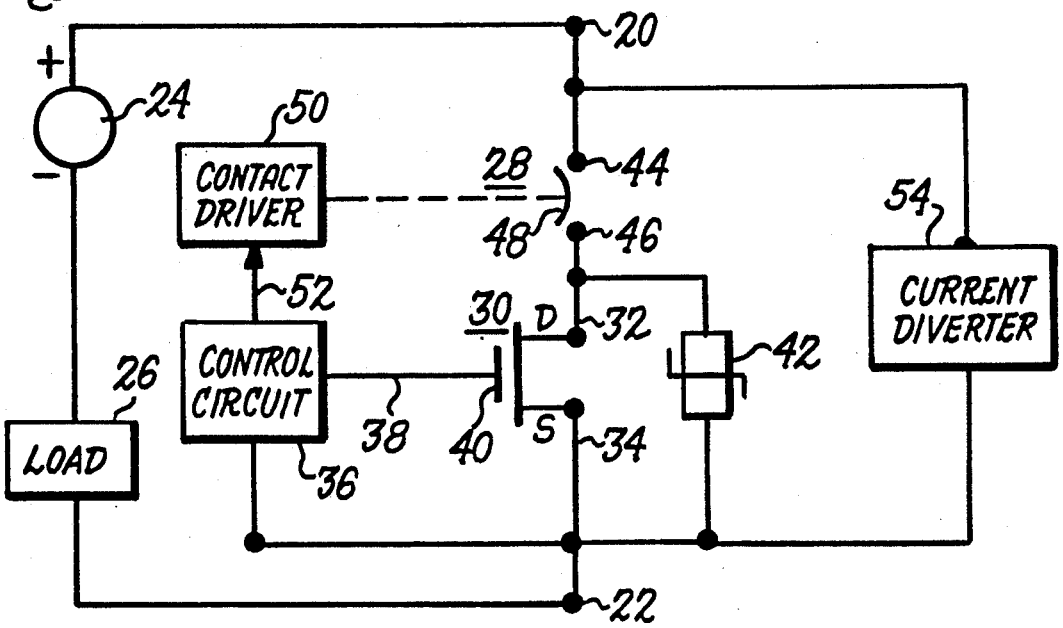
Fig. 1. PRIOR ART
FIG. 1 is a simplified schematic of a prior art circuit adapted primarily for interrupting d-c load currents.

Attention is directed to FIG. 1 which illustrates a current interruption arrangement of the type disclosed in my U.S. Pat. No. 4,636,907, issued Jan. 13, 1987. It discloses a controlled impedance circuit utilizing a field effect transistor 30, preferably a MOSFET, connected in series with a switch, a source of electrical power and a load circuit. The current interrupter circuit has output terminals 20 and 22 that are adapted for connection to a serially connected source of electric potential 24 and load circuit 26. Terminals 20 and 22 are interconnected by switch 28 and the drain 32 and source 34 of field effect transistor 30. Thus, power source 24 and load 26 are connected in a series loop circuit with switch 28 and FET 30. Control circuit 36 has an output line 38 connected to gate 40 of the field effect transistor. A voltage dependent, e.g., clamping, device 42, such as a varistor, is preferably connected between the primary electrodes, drain 32 and source 34 of the FET. The FET and voltage clamping device constitute a controlled impedance circuit. Switching means 28 is preferably of the type disclosed in U.S. Pat. No. 4,644,309, issued Feb. 17, 1987, and entitled "High Speed Contact Driver for Circuit Interruption Device". It is in the name of the subject applicant, is assigned to the assignee of the subject application and is hereby incorporated by reference. The switching means comprises fixed contacts 44 and 46 and bridging contact 48 arranged across the fixed contacts for providing load current transfer. Switching means 28 is normally closed but can be rapidly opened by displacement of the bridging contact 48 in response to a current pulse signal. If the switching means is not latchable, a separate latching switch can be serially connected with the switching means. This latching switch is opened upon opening of the switching means and may be manually reclosed. The mechanism for displacing bridging contact 48 of the switching means is schematically identified as contact driver 50. The current pulse signal for displacing bridging contact 48 is supplied by control circuit 36 to contact driver 50 via line 52. Current diverter circuit 54 is connected between terminals 20 and 22 so as to shunt serially connected switching means 28 and FET 30. Disclosures of suitable diverter circuits are identified in the preceding text.

During normal operation, switching means 28 is closed and FET 30 is in full conduction, such that power source 24 supplies load current to load 26. With adequate gate voltage, there is a minimal voltage drop across the source and drain electrodes of the FET and the FET has minimal power dissipation. Current interruption is achieved as follows. Control circuit 36 switches the signal applied via line 38 to gate 40 so as to cut off the FET. This causes the voltage across the FET to increase to the clamping potential of varistor 42. As a result, load current is diverted from the circuit comprising the switching means 28 and FET 30 to the current diverter 54. The control circuit applies a current pulse via line 52 to contact driver 50 to open switching means 28 subsequent to such load current diversion. Since there is substantially no load current flow through the switching means at the time of opening, there is virtually no arcing. A further description is contained in the referenced U.S. Pat. No. 4,636,907, issued Jan. 13, 1987.

Utilization of MOSFET devices in the above described controlled impedance circuit is desirable, particularly with load currents of large magnitude. A primary reason is that MOSFET devices can be operated in full conduction with less power dissipation than is attainable with many other types of solid state devices. In most types of solid state devices, e.g., in diodes, bipolar transistors and thyristors, current flows through one or more serially connected PN junctions. Even during saturation, each junction exhibits at least a predetermined junction voltage drop. The resulting power dissipation can therefore be considerable with high, e.g., 100%, duty cycle operation and large load currents. The junction voltage drop, and thus the power dissipation, is increased when multiple junctions are connected in series and, generally, if solid state devices having a high voltage blocking capability are utilized. However, as subsequently explained, FET devices can operate in full conduction effectively without the presence of a PN junction. Thus, utilization of MOSFET devices in controlled impedance circuits can result in a lower power dissipation. MOSFET devices are also desirable because of their particularly fast switching time and because their switching characteristics are relatively independent from changes in operating temperature.

However, the above described circuit may not be useful for diverting and interrupting alternating currents, i.e., a-c load currents. This problem occurs with respect to the circuit of FIG. 1 if an alternating current source is substituted for power source 24 and if field effect transistor 30 is the common type of power MOSFET having a conductive connection between its source and substrate.

Figure 2:
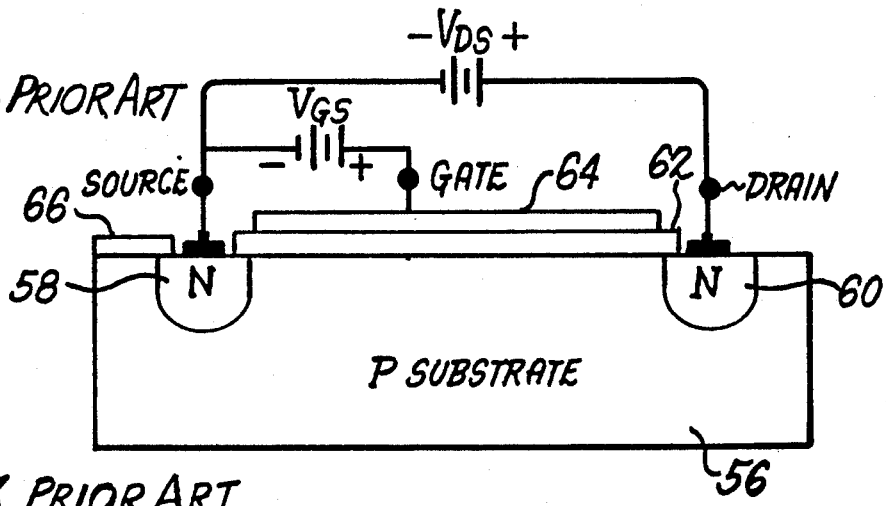
Fig. 2. PRIOR ART
FIG. 2 is a simplified representation of the cross sectional structure of a conventional n-channel enhancement-mode MOSFET device.

For an explanation of this problem, reference is made to FIG. 2. This illustrates the structure of a metal oxide silicon field effect transistor, specifically an n-channel enhancement-mode MOSFET. Silicon semiconductor material in the form of a lightly doped P-type substrate 56 incorporates two highly doped N-type regions, the source 58 and the drain 60. An insulating layer of silicon dioxide glass 62 is placed over the region between the source and the drain. A metal conductor 64 on top of the insulating layer forms the gate.

If a potential $V_{DS}$, of polarity shown in FIG. 2, is applied between source and drain (without positive gate potential), PN junctions appear, respectively, at the interface of the source and of substrate, and at the interface of the drain and the substrate. The PN junction at the source is forwarded biased and the PN junction at the drain is reverse biased. Under these conditions, there is substantially no drain current, i.e., current flow between drain and source, because of the reverse biased PN junction at the drain.

If a positive potential is now applied to the gate, free electrons are brought into the region between the source and the drain. This enhancement operation forms a continuous N-type channel in the region extending between the source and drain. This increases the conductivity of this region and essentially bypasses the PN junctions at the source and at the drain. The N-type channel thus behaves as a resistance interconnecting source and drain. This results in substantial drain current, i.e., current flow from drain to source.

If the gate potential is now switched from a positive to a zero or negative potential, the drain current should be immediately cut off. However, this is not the case as subsequently explained. The N-channel between source and drain disappears. The region between source and drain again comprises P-type material. PN junctions recur at the interface of the P-type material and the N-type material of the source and drain, respectively. When the gate voltage is switched to a zero or negative potential, a voltage builds up across the PN junction at the drain. The device has an inherent capacitance across each of the PN junctions. The voltage across the reverse biased drain junction results in drain current that charges the drain junction capacitance. This drain current flows through the P-region and through the forward biased PN junction at the source. The current through the source junction is equivalent to injecting current into the base emitter junction of a transistor so as to produce an amplified collector-emitter current. As a result, there is an increased drain current. Because of the Miller effect, this results in a large apparent increase of the capacitance across the PN junction at the drain. This cumulative action prevents rapid shut off and results in high power dissipation during cut off.

Figure 3:
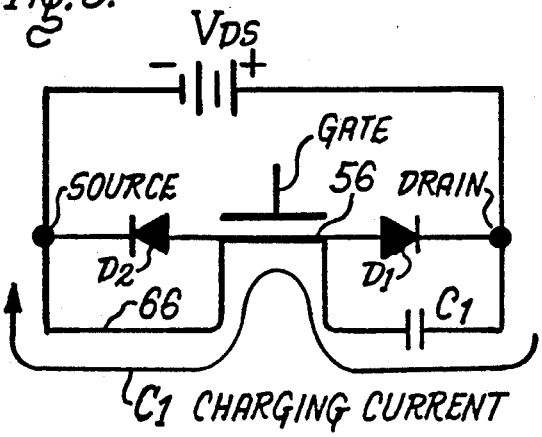
Fig. 3. PRIOR ART
FIG. 3 is a schematic representation of a conventional power MOSFET device and of the current charging the drain-substrate capacitance.

Conventional power MOSFET devices eliminate this problem by a conductive connection between the substrate and the source as indicated by conductive member 66 in FIG. 3. This effectively shorts the PN junction between the source and the substrate. When the gate potential is switched from a positive to a zero or negative potential, the drain-substrate capacitor is charged by drain current flowing to the source through the P-type region and the short circuit about the source substrate junction. Since current is not injected into the junction between source and the substrate, the previously described transistor action is prevented. Thus, conventional power MOSFET devices can be rapidly switched off with minimal power dissipation. The capacitor charging current flow and relevant components of the MOSFET are schematically illustrated in FIG. 3. This illustrates the drain-substrate junction, $D_1$, and the source-substrate junction, $D_2$, which are essentially interconnected by the substrate 56 and are poled back to back. The inherent drain-substrate capacitance $C_1$ shunts junction $D_1$ and the above described substrate-source connection 66 shunts and thus shorts junction $D_2$. When the MOSFET device is operated in the cut off mode, i.e., with zero or negative gate potential, the sole operative PN junction, $D_1$, blocks the conduction of drain current. When the device is operated in the conduction mode, i.e., with a positive gate potential, current flows from drain to source via the intervening N-channel without any intervening junctions.

Figure 4:
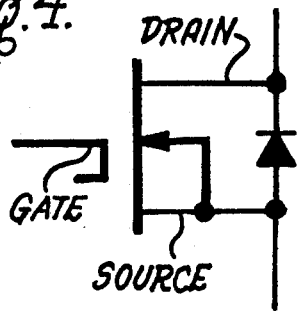
Fig. 4. PRIOR ART
FIG. 4 is a symbolic representation of a conventional power MOSFET device.

A conventional power MOSFET of this type operates satisfactorily in the arrangement for diverting and interrupting d-c load currents illustrated in FIG. 1. Based on the preceding description relating to FIG. 3, the symbolic representation of the field effect transistor 30 of FIG. 1 can be redrawn as illustrated in FIG. 4. FIG. 4 conventionally illustrates the three electrodes, the source, drain and gate. It further illustrates the connection between the source and substrate. The arrow pointing to the substrate denotes a device having a P-type substrate and thus an N-channel during conduction. (P-channel MOSFET devices could also be used subject to appropriate reversal of voltages and current.) The diode connected between the source and drain represents the single operative junction of the device, i.e., the diode junction between drain and substrate identified as $D_1$ in FIG. 3. This is poled to block conduction when the drain is positive with respect to the source and the gate voltage is zero or negative. As explained subsequently, such a MOSFET device can therefore block current in only one direction of applied voltage, i.e., it has an unsymmetrical blocking characteristic.

Assume now that the arrangement of FIG. 1 is to be used to divert and interrupt an alternating current, i.e., that the source of d-c potential 24 is replaced with a source of a-c potential. During normal operation, with switch 28 closed, an alternating potential is applied across the drain and source of FET 30. While control circuit 36 applies a positive potential to gate 40 via line 38, FET 30 fully conducts, i.e., is in the saturation mode. FET 30 properly conducts during both half cycles of the a-c potential applied across source and drain. It can conduct current in either direction, i.e., it has a symmetrical conduction characteristic, since there is virtually no diode junction, and thus no reverse biased blocking junction, present because of the N-channel produced by the positive gate voltage.

Load current interruption is preceded by diverting load current from the first circuit, comprising switch 28 and the primary electrodes of FET 30, to current diverter 54. Diversion results from control circuit 36 switching the potential of gate 40 from a positive to a zero or negative potential. If this occurs during an interval when the a-c source of potential applies a positive voltage to the drain, with respect to the source, FET 30 is properly cut off in the manner previously described. Cut off occurs primarily because of the blocking action of the drain-substrate diode junction which is identified as $D_1$ in FIG. 3. With reference to the symbolic representation of the MOSFET device of FIG. 4, it can be seen that this diode is reverse biased and thus in a blocking mode when the drain is positive with respect to the source. With FET 30 cut off, the load current diverts to the current diverter, i.e., interrupter circuit 54. Upon current diversion, control circuit 36 applies a current pulse to contact driver 50 to open switch 28. This process is extremely fast. It can be accomplished in the order of microseconds, i.e., within a fraction of the time of a half cycle of the a-c potential applied by the a-c power source.

However, a different situation occurs if load current diversion is commanded and the gate potential is switched to zero or a negative voltage during the interval when the potential of drain 32 of FET 30 is negative with respect to source 34. This corresponds essentially to reversing the polarity of the voltage source $V_{DS}$ of FIG. 3. As evident therefrom and from FIG. 4, the sole operative junction, the drain-substrate junction, is now forward biased. Current conduction through the FET is not terminated by the diode junction and thus is not cut off. Therefore, it is unlikely that a sufficient voltage drop is produced across the FET to provide current diversion.

One conceivable solution is to modify control circuit 36 so that diversion can be effected only during half cycles of the source of a-c potential when the drain is positive with respect to the gate. However, such an arrangement is likely to unduly delay the diversion process and thus is undesirable in many applications. For example, in the event of a short circuit fault, diversion and interruption should occur immediately upon detection of an overload to prevent the load current from attaining an excessive amplitude prior to interruption.

Figure 5:
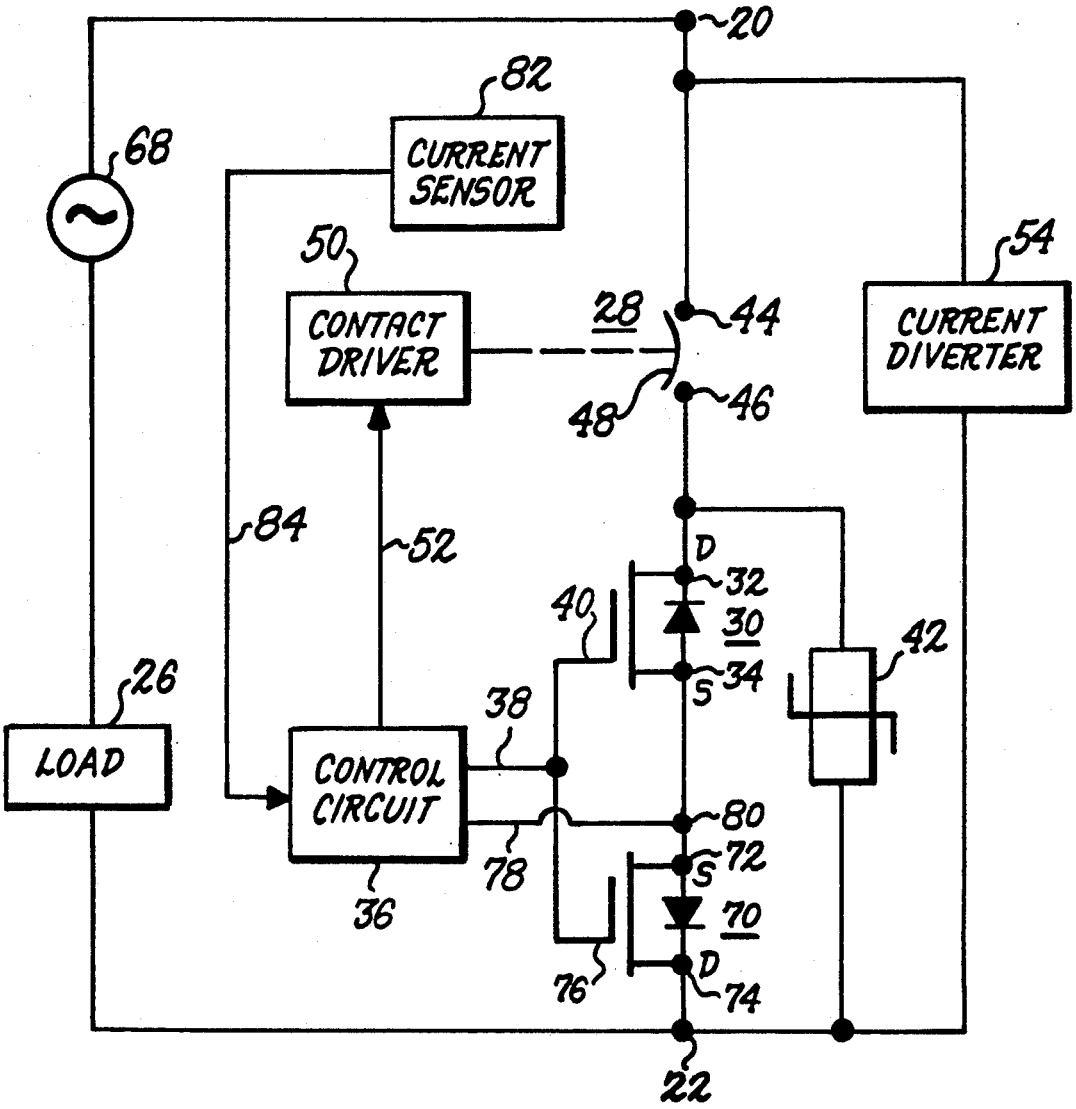
FIG. 5 is a simplified schematic of one embodiment of the invention for diverting and interrupting a-c load currents.

FIG. 5 illustrates one embodiment of the invention for diverting and interrupting a-c load current whenever commanded notwithstanding the instantaneous polarity of the voltage applied between the drain and source of the field effect transistor. The circuit of FIG. 5 generally corresponds to that of FIG. 1 except as follows: A source of a-c potential 68 is substituted for the d-c source 24 so as to be connected in series with load 26 between input terminals 20 and 22. However, the circuit of FIG. 5 could also be operated with a source of d-c instead of a-c potential. A second field effect transistor 70 is connected back to back, i.e. inversely, in series with the first field effect transistor 30. Thus, its source 72 is connected to source 34 of FET 30 and its drain 74 is connected to output terminal 22. The gate 76 of FET 70 is connected in parallel with gate 40 of FET 30 so as to be connected via line 38 to an output of control circuit 36. A complementary, i.e., common, line 78 is connected between control circuit 36 and the junction 80 of the source electrodes 34 and 72 of field effect transistors 30 and 70. A voltage dependent device, e.g., varistor 42, is connected across the field effect transistors, i.e., between drain electrode 32 and terminal 22. Current sensor 82 may be connected via line 84 to an input of control circuit 36. This current sensing arrangement has been disclosed in applicant's U.S. Pat. No. 4,723,187, issued Feb. 2, 1988.

Operation is described based on the assumption that a-c load current flows through the first circuit comprising closed switch 28 and serially connected field effect transistors 30 and 70, but that load current flow is to be interrupted if it exceeds a predetermined allowable magnitude. Control circuit 36 normally applies a positive voltage via line 38 to base electrodes 40 and 76 of the field effect transistors 30 and 70 so that both are in full conduction. Current sensor 82 provides to control circuit 36 a signal representative of the magnitude of line current. When the line current exceeds the predetermined allowable magnitude, the potential applied by control circuit 36 to the base electrodes switches from a positive to a zero or negative potential. One of the back to back connected field effect transistors is thus cut off. If, at this time, the potential at drain electrode 32 of device 30 is positive with respect to terminal 22, device 30 cuts off. If it is negative, device 70 cuts off since the potential at its drain electrode 74 is then positive with respect to its source electrode 72. Thus, by connecting two FET devices back to back, one of them will be cut off notwithstanding the instantaneous polarity of the a-c potential across their primary electrodes, e.g., across drain electrodes 32 and 74.

Upon cut off of the field effect transistors, operation continues in the manner previously described. specifically the voltage drop across the field effect transistors causes current diversion through current diverter 54. Subsequent to current diversion, switch 28 is opened responsive to a current pulse supplied by control circuit 36 over line 52 to contact driver 50.

The circuit of FIG. 5 effectively diverts and interrupts a-c as well as d-c load current. However, it has one disadvantage. The series on-state resistance of the two serially connected FET devices is essentially twice that of a single device. The voltage drop of the two FET devices, operating in saturation, can approach or even exceed that of a single bi-polar conventional device. Therefore, excessive power may be dissipated under normal operation when load current flows through the two serially connected FET devices.

Figure 6:
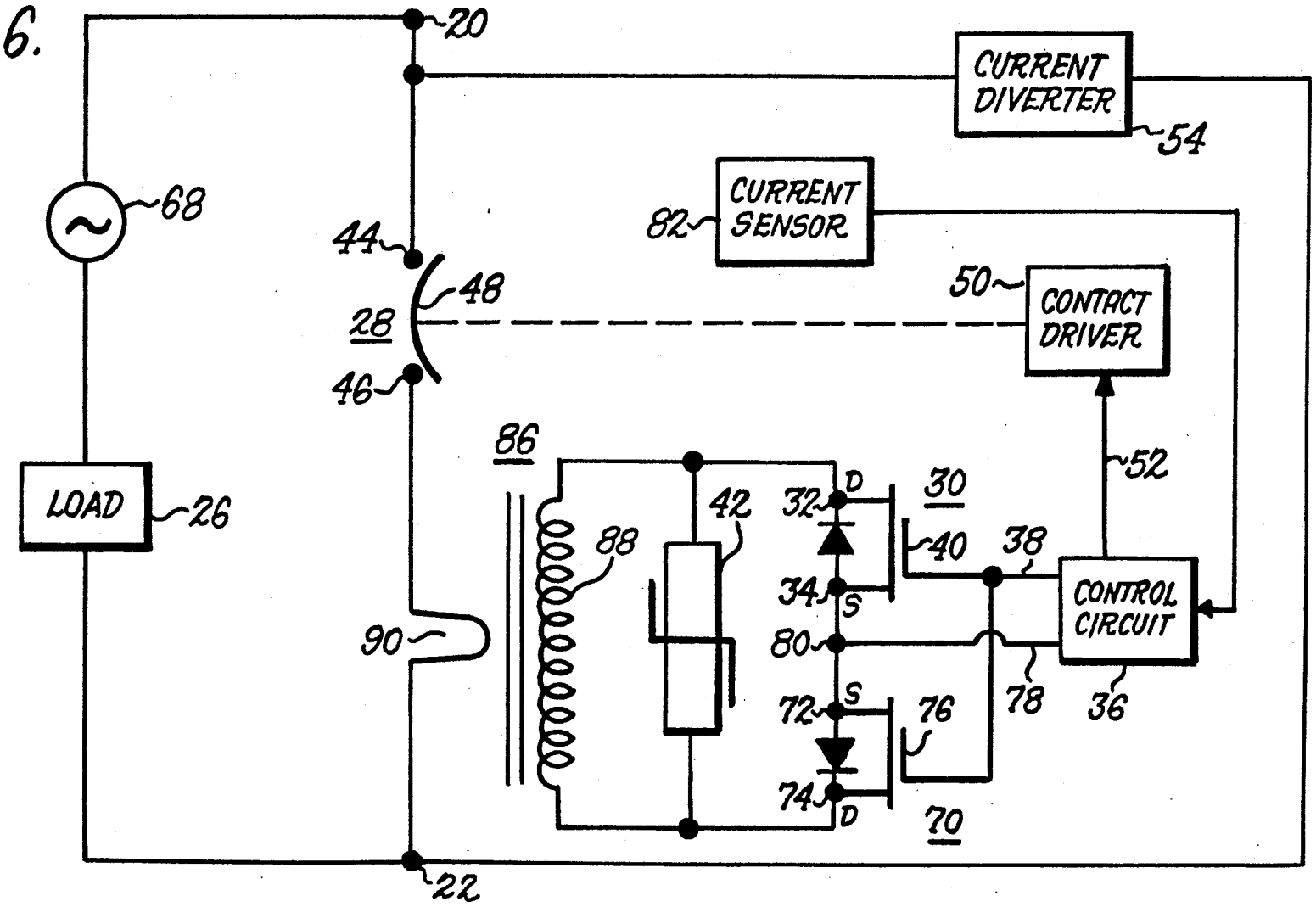
FIG. 6 is a simplified schematic of an alternative embodiment of the invention utilizing a transformer coupling arrangement.

FIG. 6 illustrates an alternative embodiment that provides reduced power dissipation. This is an improvement of an arrangement disclosed in my U.S. Pat. No. 4,636,907, issued Jan. 13, 1987, wherein the solid state switching means for diverting current is transformer coupled from the first circuit that normally carries the load current. The circuit of FIG. 6 corresponds to that of FIG. 5 except for the addition of a transformer coupling. Specifically, the back to back connected field effect transistors 30 and 70 have their drain electrodes 32 and 74 connected to secondary winding 88 of transformer 86. The primary winding 90 of this transformer is connected in series with switch 28 in the first circuit. The secondary winding 88, which has a greater number of turns than the primary winding, is thus connected in a series loop circuit with the back to back connected field effect transistors. During full conduction of the FETs, the impedance of the primary winding, and thus its power dissipation, is very low because of the transformer turns ratio. Back to back connected FET devices 30 and 70 constitute solid state means capable, under control of the control circuit 36, of bilateral conduction and of bilateral blocking. As described, bilateral conduction means that they can fully conduct notwithstanding the polarity of the a-c voltage applied across their main electrodes. Bilateral blocking means that conduction can be terminated notwithstanding the polarity of this a-c voltage. In the transformer coupled embodiment of U.S. Pat. No. 4,636,907, issued Jan. 13, 1987, the transformer secondary winding is connected in a series loop circuit with a bridge rectifier and a Darlington bipolar transistor pair. During conduction of the Darlington, current flows serially through two junctions of the bridge and a junction of the Darlington. Thus, with full conduction, there is a voltage drop equivalent to the sum of at least three diode junction potentials. This necessitates a sufficient step up ratio between the primary and secondary transformer windings to minimize power dissipation in the primary winding. However, the ratio results in a substantial voltage across the secondary winding, which requires use of solid state devices having a higher voltage blocking capability and thus, most likely, a higher junction potential drop. The bridge rectifier is used because the Darlington pair does not have an inherent bilateral conduction and blocking capability. The arrangement of FIG. 6 eliminates the bridge rectifier. This permits the elimination of a plurality of power rectifiers and thus saves costs. It also reduces the number of serially connected PN junctions and thus reduces the voltage drop that appears across the circuit during saturation. Since the turns ratio can be reduced, solid state switching devices having a lower blocking rating might be utilized.

Figure 7:
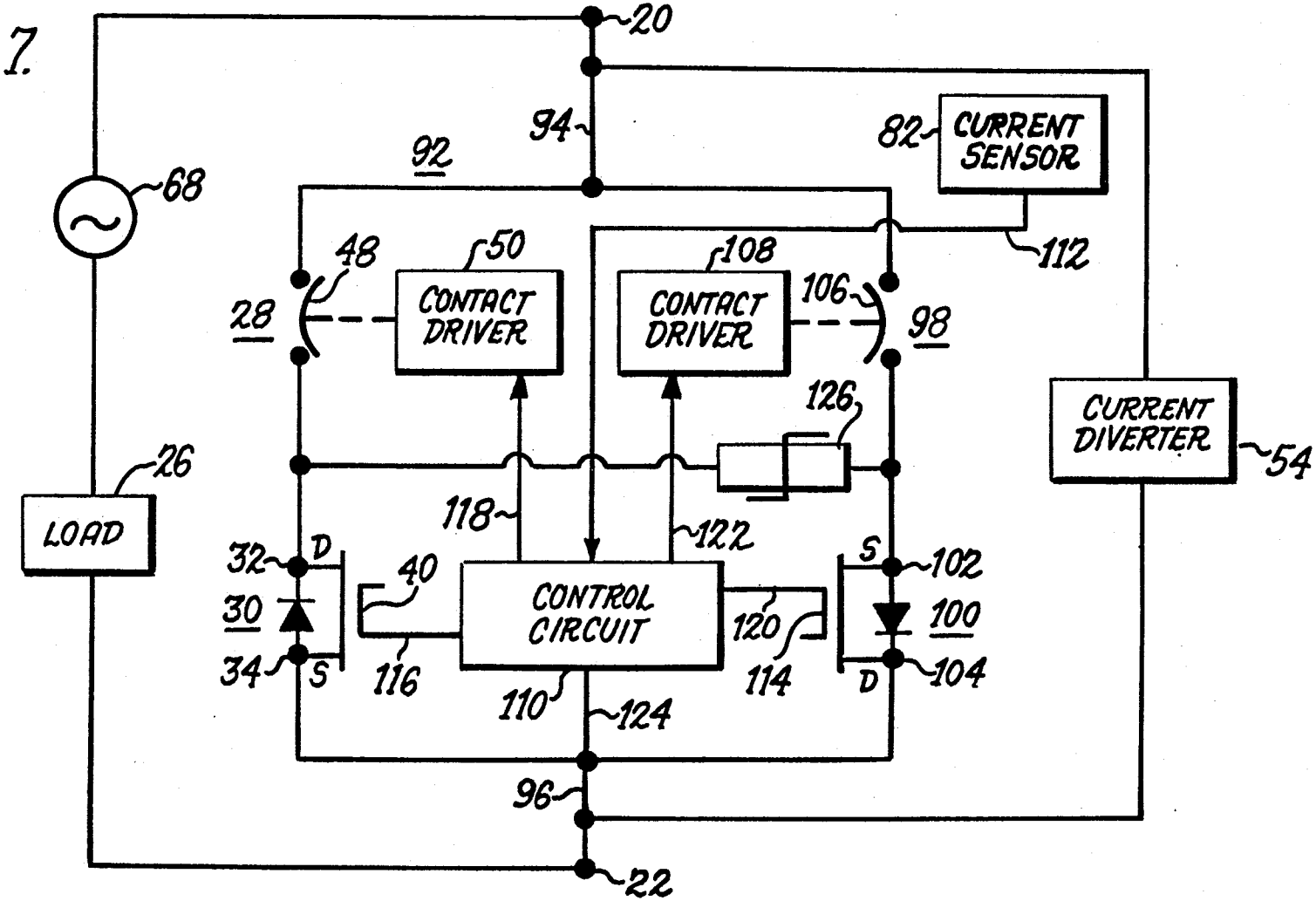
FIG. 7 is a simplified schematic of a further alternative embodiment of the invention having two parallel paths, each of which includes a MOSFET device.

FIG. 7 illustrates an alternative embodiment for diverting and interrupting a-c or d-c load current. This embodiment has minimal power dissipation, i.e., substantially less than that of the embodiment of FIG. 5. It also does not require transformer coupling the solid state devices of the controlled impedance circuit as disclosed in the embodiment of FIG. 6. The a-c source 68 and load 26 are serially connected across terminals 20 and 22 and the current diverter 54 is connected across these terminals as in the embodiments of FIGS. 5 and 6. Terminals 20 and 22 are connected to the switch and controlled impedance network 92 via lines 94 and 96, respectively. Network 92 comprises two parallel connected branches, each comprising a switch and a controlled impedance circuit, i.e., MOSFET device, and a current sensor. The first branch, connected between lines 94 and 96, comprises serially connected first switch 28 and first field effect transistor 30. The second branch, also connected between lines 94 and 96, comprises serially connected second switch 98 and second field effect transistor 100. The drain and source electrodes of these two transistors are reversed with respect to one another. Drain 32 of the first MOSFET 30 is connected to the first switch 28 and its source 34 is connected to line 96. Source 102 of the second MOSFET 100 is connected to second switch 98 and its drain 104 is connected to line 96. The bridging contact 48 of the first switch is actuated by a first contact driver 50 and the bridging contact 106 of the second switch 98 is actuated by a second contact driver 108. A control circuit 110 receives an input from current sensor 82 via line 112. It has output lines 116, 118, 120 and 122 applied respectively to gate 40 of first MOSFET 30, contact driver 50, gate 114 of second MOSFET 100 and contact driver 108. The control circuit also has a common line 124 connected to line 96. A voltage dependent device, e.g., varistor 126, is preferably connected from the junction of the first MOSFET 30 and the first switch 28 to the junction of the second MOSFET 100 and the second switch 98. Device 126 thus clamps the maximum potential obtainable across the MOSFET devices.

Operation is described based on the assumption that a-c load current initially flows through both parallel branches. Switches 28 and 98 are both closed. MOSFET devices 30 and 100 are in full, i.e., saturation, conduction because of a positive potential applied by the control circuit, via lines 116 and 120, to the gate electrodes 40 and 114 of both MOSFET devices 30 and 100. Devices 30 and 100 each have a minimal potential drop, e.g., of the order of 0.01 volts. Under these conditions, there is minimal power dissipation. The total on resistance of the two devices 30 and 100 conducting in parallel is only half that of a single device and only one quarter of the on resistance of two devices connected in series. Thus, the power dissipation of the circuit of FIG. 7 is substantially less, e.g., one quarter that of the circuit of FIG. 5. However, the arrangement of FIG. 7 requires a more complex control arrangement for the following reason. In the previously described embodiments, current diversion results merely from applying a zero or negative potential to the gate circuit of one or two MOSFET devices so as to cut off the drain to source conduction. However, in the circuit of FIG. 7, current flows through two oppositely poled MOSFET devices 30 and 100 that are essentially connected in parallel. Since these devices have unsymmetrical blocking characteristics, they can not be simultaneously cut off in this manner. For example, assume that diversion is commanded when the instantaneous polarity of the a-c source is negative at terminal 20 and positive at terminal 22 with current flowing from terminal 22 to terminal 20. The inherent junction diode of MOSFET 30 is then forward poled, i.e., poled in the direction of current conduction. If the gate 40 of device 30 is then switched from a positive to a zero or negative potential, device 30 is not blocked, i.e., its current flow is not cut off.

The following describes how current diversion and interruption occurs. Current sensor 82 applies a signal representative of the a-c load current via line 112 to control circuit 110. The control circuit thus identifies when the a-c load current exceeds its maximum allowable magnitude and also the instantaneous direction of current flow at such time. The control circuit thereupon first switches the gate potential of the MOSFET device whose inherent diode junction is forward poled at this time. Assuming that this occurs when load current flows from terminal 22 to terminal 20, the inherent diode junction of MOSFET 30, but not of MOSFET 100, is forward poled. Accordingly, control circuit 110 switches the potential on line 116, and thus gate 40 of device 30, from a positive to a zero or negative potential. Load current in device 30 now flows through the inherent junction diode of the device. The potential drop across the device increases to the potential drop across the inherent diode junction which may be in the order of 0.8 volts. The other MOSFET device 100 is still in full, i.e., saturation, conduction. It then has no inherent junction diode and thus has a lower potential drop, such as, for example, 0.01 volts. The potential drop across device 30 is then substantially greater than that across device 100. The voltage drop across the first branch is therefore greater than that across the second branch. This causes the load current flowing through the first branch to transfer to the second branch. Substantially all, or at least the major portion, of the load current then flows through the second branch. This major diversion results because the percentage of load current diversion is inversely related logarithmically to the ratio of the potential drops across the respective MOSFET devices.

Upon transfer of load current from the first branch to the second branch, control circuit 110 opens switch 28 of the first branch substantially under zero current conditions. Specifically, it supplies a current pulse on line 118 to contact driver 50 which thereupon opens bridging contact 48.

Next, control circuit 110 turns off FET device 100. Specifically, it switches the potential on line 120, and thus on gate 114, from a positive to a zero or negative potential. Since the inherent junction diode of device 100 is then reverse poled, this cuts off conduction of device 100. (Device 126 limits the potential across device 100 to a predetermined allowable value.) This causes load current in the second branch to divert to current diverter 54.

Finally, upon load current diversion to diverter 54, control circuit 110 opens switch 98 under substantially zero current conditions. Specifically, a current pulse is supplied via line 122 to contact driver 108.

Figure 8:
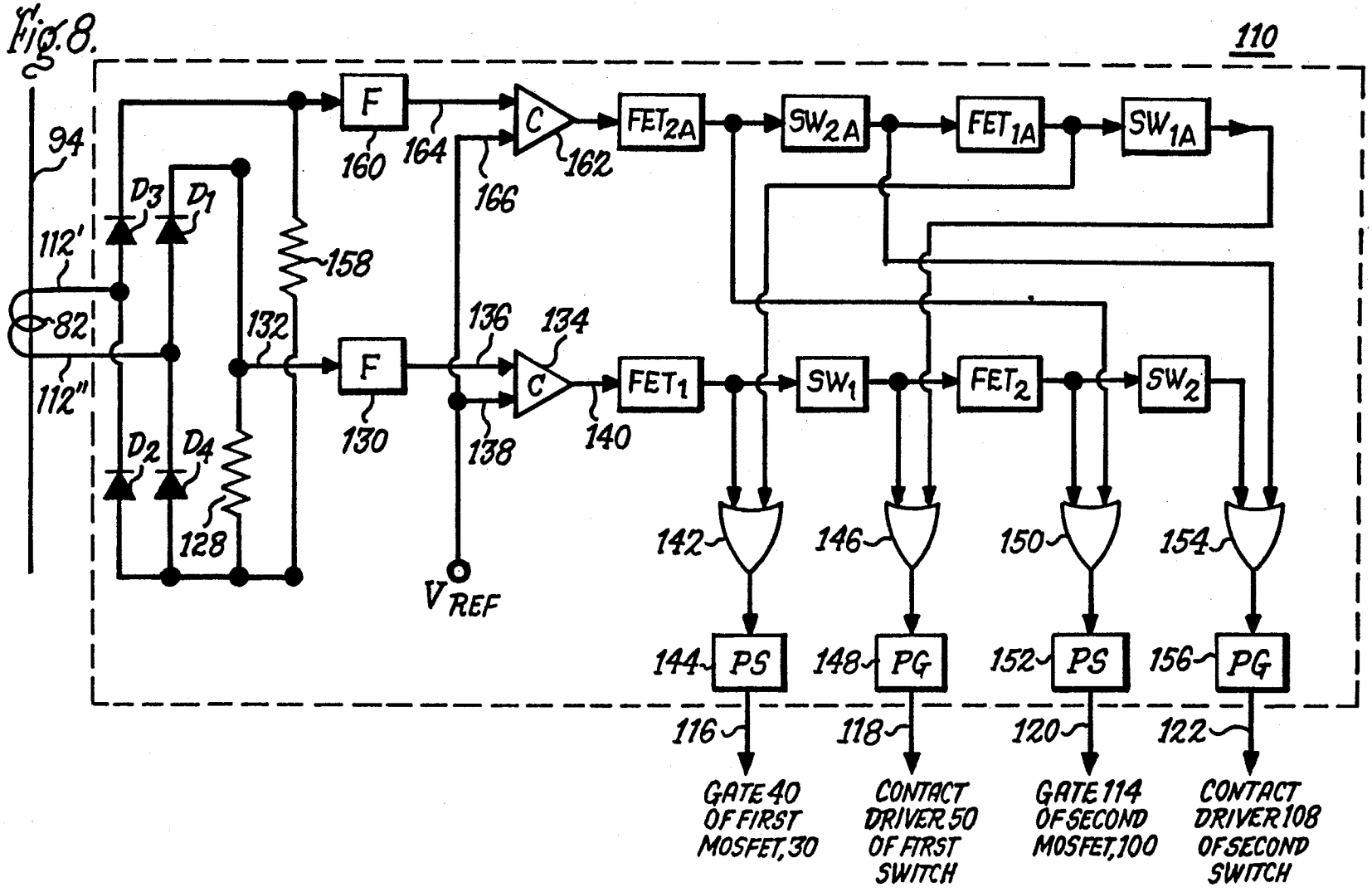
FIG. 8 is a block diagram of one embodiment of a current sensing and control circuit for use with the embodiment of FIG. 7.

FIG. 8 illustrates a simplified block diagram of one embodiment of current sensor 82 and of control circuit 110 including its output lines 116, 118, 120 and 122. This continuously detects the amplitude and the direction of the load current. If load current exceeds a predetermined maximum allowable value, the control circuit supplies control signals necessary to perform the above described current transfer and diversion operation. The control signals have a predetermined sequence. First, the FET whose inherent diode junction is then forward poled is gated off, i.e., its gate potential is switched to a zero or negative value, to transfer its load current to the other parallel branch. Second, the switch associated with that FET is opened in response to a current pulse signal applied by the control circuit. Third, the FET of the other branch is gated off to divert the load current to the current diverter. Fourth, the switch associated with this FET is opened in response to a current pulse signal applied by the control circuit. These operations must be performed not only in the proper sequence, but also at appropriate intervals. In the embodiment of FIG. 8, these operations are successively performed at predetermined time intervals. The time occurrence of the current pulses that are applied by the control circuit to the contact drivers of the switches must reflect the time that elapses between the application of the current pulse and the subsequent opening of the switch. Switches of the type previously proposed by me, e.g., in U.S. Pat. No. 4,644,309, issued Feb. 17, 1987, open very rapidly. They open within a few microseconds of the application of the current pulse. Therefore, in this embodiment, the current pulse for opening a switch issues shortly after its associated FET device is gated off. However, in some cases it may be desirable to supply the current pulse earlier. For example, the current pulse might be applied simultaneously with the gating of the FET device. In some instances the current pulse may even be applied before the FET device is gated off, such as for example when utilizing slower switches. This applies to the various embodiments, including those of FIGS. 5-7.

The specific sequence in which the control signals are issued depends upon the instantaneous direction of the load current at the time diversion and interruption is initiated. Specifically, it depends on which of the two FET devices has its inherent diode forward biased at the time. If this is the FET of the first branch, control signals are initially applied to that FET and to the switch of the first branch and subsequently to the FET and to the switch of the second branch. The control circuit 110 of FIG. 8 includes a first chain of devices to provide appropriately timed control signals if the FET of the first branch has its inherent diode forward poled.

The control signals produced by this first chain sequentially control FET 30 and switch 28 of the first branch and subsequently FET 100 and switch 98 of the second branch. However, if the FET of the second branch has its inherent diode forward poled during diversion and interruption, control signals are first applied to the FET and to the switch of the second branch and subsequently to the FET and switch of the first branch. The control circuit 110 of FIG. 8 therefore includes a second chain of devices to provide these control signals. These appropriately timed signals of the second chain sequentially control FET 100 and switch 98 of the second branch and subsequently FET 30 and switch 98 of the first branch.

The embodiment is now described with reference to FIG. 8. Current sensor 82 comprises a secondary winding about load current line 94. This constitutes a current transformer whose output is coupled via lines 112' and 112'' to control circuit 110 shown by dashed lines. The subsequently described components are all within control circuit 110. Lines 112' and 112'' are connected in a first series loop comprising diode $D_1$, burden resistor 128 and diode $D_2$. The diodes are poled for unidirectional conduction such that load current flow in the direction from terminal 22 to terminal 20 (FIG. 7) produces a voltage across resistor 128. This voltage thus appears whenever the inherent diode of FET 30 is forward poled. The output of resistor 128 is applied to device 130 via line 132. Device 130 provides any filtering of the half wave signal necessary to remove spurious transients that otherwise could improperly initiate current interruption. The output of device 130 is applied to a first input 136 of comparator 134. A source of d-c reference voltage, $V_{REF}$, is applied to a second input 138 of the comparator. The reference potential is adjusted to a value equivalent to the maximum allowable value of load current. If the load current exceeds this maximum value, i.e., if the magnitude of the signal on first input 136 exceeds the reference potential on second input 138, the comparator output 140 switches from a first value, e.g., a negative saturation limit, to a second value, e.g., a positive saturation limit. This transition initiates the control signals that transfer load current from the first to the second branch, divert load current to the current diverter and open the switches.

The output 140 of the comparator is applied to signal shaping circuit $FET_1$. This provides an appropriate quiescent output level, e.g., zero volts, and also a properly shaped trigger signal, e.g., a positive pulse, responsive to transition of the comparator output. The output of circuit $FET_1$ is supplied to one input of first OR gate 142 and to the input of time delay circuit $SW_1$. Responsive to a pulse on at least one of its inputs, the OR gate provides an output pulse to pulse shaping circuit 144. The output of circuit 144 is coupled via line 116 to gate 40 of MOSFET 30 in the first branch. Circuit 144 normally supplies a positive voltage to gate 40 to support conduction of MOSFET 30. However, responsive to a transition of the comparator output, its output is switched to a zero or negative potential for a sufficient time period to assure transfer of load current from the first to the second branch. Time delay circuit $SW_1$ has a quiescent, e.g., zero level, output, but produces a pulse output at a predetermined time subsequent to the occurrence of the pulse provided to its input by the device $FET_1$. The output pulse of $SW_1$ is supplied to one input of OR gate 146 and to time delay device $FET_2$. OR gate 146, responsive to a pulse applied to its input, provides an output pulse to current pulse generator 148. Device 148 provides a current pulse via line 118 to contact driver 50 to open switch 28 of the first branch circuit.

Time delay device $FET_2$ also has a quiescent, e.g., zero level, output and produces a pulse output at a predetermined time subsequent to occurrence of the pulse provided to its input by device $SW_1$. The output pulse of $FET_2$ is supplied to one input of a third OR gate 150 and to the input of device $SW_2$. The corresponding output of OR gate 150 is supplied to pulse shaping circuit 152, which is of the same type as pulse shaping circuit 144. The output of circuit 152, connected via line 120 to gate 114 of MOSFET 100, switches from a positive to a zero or negative potential responsive to the output pulse of device $FET_2$. This diverts load current from the second branch to current diverter 54.

Finally device $SW_2$, which corresponds in type and function to that of device $SW_1$, provides a pulse output to one input of a fourth OR gate 154. The output pulse of this OR gate, which occurs a predetermined time subsequent to the pulse applied to the input of device $SW_2$, is applied to pulse generator 156. Device 156 provides a current pulse via line 122 to contact driver 108 to open switch 98 in the second branch circuit.

The above described portion of the control circuit provides control signals to divert and interrupt load current responsive to overload currents sensed during intervals when a-c load current flows in a first predetermined direction, i.e., from terminal 22 to terminal 20. An additional equivalent arrangement performs this function during intervals when a-c load current flows in the opposite direction, i.e., from terminal 20 to 22. Control circuit input lines 112' and 112'' are connected in a second series loop comprising diode $D_3$, burden resistor 158 and diode $D_4$. These diodes are poled for unidirectional conduction such that load current flow in the direction from terminal 20 to terminal 22 produces a voltage across resistor 158. This voltage thus appears whenever the inherent diode of FET 100, in the second branch, is forward poled. The output of resistor 158 is applied via filter device 160 to a first input 164 of comparator 162. Device 160 corresponds to and performs the filtering functions of device 130. The d-c reference potential, $V_{REF}$, is applied to a second input 166 of comparator 162. If load current exceeds the maximum allowable value of load current, the output of comparator 162 switches in the manner previously described. This transition initiates the control signals that transfer load current from the second to the first branch, divert load current to the current diverter and open the switches.

The output of comparator 162 is applied sequentially to a second chain of device that correspond to those of the first chain that was previously described. Thus, the comparator output is connected to the input of pulse shaping circuit $FET_{2A}$ that corresponds to circuit $FET_1$. The output of $FET_{2A}$ is connected in cascade to time delay devices $SW_{2A}$, $FET_{1A}$ and $SW_{1A}$, respectively. Each of these corresponds to its counterpart of the first chain, i.e., $SW_{2A}$ to $SW_1$, $FET_{1A}$ to $FET_2$, and $SW_{1A}$ to $SW_2$. The operation of this second chain conforms to that of the first chain except for the sequence of the control signals. The first chain produces control signals for the first branch prior to those for the second branch, in the sequence of $FET_1$, $SW_1$, $FET_2$, $SW_2$. The second chain produces control signals for the second branch prior to those of the first branch in the sequence $FET_{2A}$, $SW_{2A}$, $FET_{1A}$, $SW_{1A}$. The outputs of the devices in the second chain are supplied to second inputs of the previously described OR gates to as to avoid redundancy of the pulse shaping and pulse generating circuits and of control lines. Thus, pulses applied by either the first or the second chain will generate the proper control signal. The outputs of the devices of the second chain are of course connected to inputs of the OR gates that initiate the appropriate control signal. Specifically, device outputs are connected to the second inputs of OR gates as follows: $FET_{2A}$ to OR gate 150; $SW_{2A}$ to OR gate 154; $FET_{1A}$ to OR gate 142; and $SW_{1A}$ to OR gate 146.

It should be apparent to those skilled in the art that while embodiments have been described in accordance with the Patent Statutes, changes may be made in the disclosed embodiments without actually departing from the true spirit and scope of the invention. For example, the embodiments disclosed herein may utilize parallel connected transistors and sets of separable contacts to accommodate higher currents and to permit the use of plural separable contact structures. Specifically, they may utilize a plurality of parallel connected semiconductor devices instead of a single device, plural sets of parallel connected separable contacts instead of a single set of separable contacts, or parallel arrays of separable contacts and semiconductor devices instead of a single set of separable contacts and a single semiconductor device.

What I claim as new and desire to secure by Letters Patent of the United States is as follows:

1. An arrangement responsive to a current interruption command for rapidly interrupting the flow of load current from a source of alternating current to an electric load notwithstanding the direction of load current at the occurrence of the current interruption command, comprising:

a. switching means comprising separable contact means;

b. controlled impedance means serially connected with said separable contact means intermediate a source of alternating current and an electrical load;

c. said controlled impedance means comprising a plurality of field effect transistors comprising source, drain and date electrodes; said field effect transistors being capable of bilateral conduction and of unilateral, but not bilateral, current blocking between the source and the drain electrodes because of their having a single inherent junction;

d. said plurality of field effect transistors being biased, during normal operation, for maximum conductivity across their source and drain electrodes so that load current flow produces a minimal voltage drop across the controlled impedance means;

e. at least one pair of said field effect transistors being connected to have their source and drain electrodes oppositely poled for current flow, during normal operation, from the drain to the source electrode of one of said pair and from the source to the drain electrode of the other of said pair;

f. control means responsive to a current interruption command to vary the bias applied in circuit with at least the gate electrode of one of said pair to reduce the conductivity across the source and drain electrodes of at least one of said pair of field effect transistors to increase the voltage drop produced across said controlled impedance means not withstanding the direction of load current flow at the occurrence of the current interruption command;

g. current diversion means connected in parallel circuit with the serially connected separable contact means and controlled impedance means for temporarily diverting load current flow upon increase of the voltage drop across the controlled impedance means;

h. means for opening said separable contact means upon diversion of the load current to the current diversion means, the field effect transistors of said at least one pair are connected back to back in a series circuit with the drain or source electrode of one of the field effect transistors being connected to a like electrode of the other of said transistors, the gate electrodes of the back to back connected transistors are connected in parallel and said control means has an output coupled to the aforesaid gate electrodes and the junction of the back to back connected transistors.

2. The arrangement of claim 1 further comprising current sensing means providing to said control means a signal representative of the magnitude of load current, said control means switching its output in response to load current exceeding a predetermined magnitude such that at least one of the back to back connected transistors is switched from conduction to cut off.

3. An arrangement responsive to a current interruption command for rapidly interrupting the flow of load current form a source of alternating current to an electric load notwithstanding the direction of load current at the occurrence of the current interruption command, comprising:

a. switching means comprising separable contact means;

b. controlled impedance means serially connected with said separable contact means intermediate a source of alternating current and an electrical load;

c. said controlled impedance means comprising a plurality of field effect transistors comprising source, drain and gate electrodes; said field effect transistors being capable of bilateral conduction and of unilateral, but not bilateral, current blocking between the source and the drain electrodes because of their having a single inherent junction;

d. said plurality of field effect transistors being biased, during normal operation, for maximum conductivity across their source and drain electrodes so that load current flow produces a minimal voltage drop across the controlled impedance means;

e. at least one pair of said field effect transistors being connected to have their source and drain electrodes oppositely poled for current flow, during normal operation, from the drain to the source electrode of one of said pair and from the source to the drain electrode of the other of said pair;

f. control means responsive to a current interruption command to vary the bias applied in circuit with at least the gate electrode of one of said pair to reduce the conductivity across the source and drain electrodes of at least one of said pair of field effect transistors to increase the voltage drop produced across said controlled impedance means not withstanding the direction of load current flow at the occurrence of the current interruption command;

g. current diversion means connected in parallel circuit with the serially connected separable contact means and controlled impedance means for temporarily diverting load current flow upon increase of the voltage drop across the controlled impedance means;

h. means for opening said separable contact means upon diversion of the load current to the current diversion means;

i. said switching means comprising first and second separable contact means connected, respectively, in series with first and second ones of said at last one pair of field effect transistors so as to constitute a first branch circuit comprising the serially connected first separable contact means and first field effect transistor and a second branch circuit comprising the serially connected second separable contact means and second field effect transistor;

j. said first and second branch circuits being connected in parallel circuit with each other and said current diversion means such that the drain and source electrodes, and thus the inherent junction diodes, of the first and second field effect transistors are oppositely poled with respect to one another;

k. said control means further comprising:

1. first means responsive to a current interruption command to increase the potential between drain and source electrodes of the one of said transistors whose inherent junction is forward poled so as to transfer load current from one to the other of said branch circuits and to thereupon open the separable contact means of the one of said branch circuits;

2. second means to cut off the transistor whose inherent junction is reverse poled so as to transfer load current from the other of said branch circuits to said current diversion means and to thereupon open the separable contact means of the other of said branch circuits.

4. The arrangement of claim 3 wherein said first and second means of the control means collectively comprise:

a. a first circuit for switching the gate bias of the first one of the pair of field effect transistors from a state of conduction to effect load current transfer and to thereupon open the first separable contact means;

b. a second circuit for switching the gate bias of the second one of the pair of field effect transistors from a state of conduction to effect load current transfer and to thereupon open the second separable contact means;

c. means responsive to a current interruption command to sequentially activate one and then the other of said first circuit and second circuit; and d. means responsive to the direction of load current upon occurrence of the current interruption command to initially activate the one of the first circuit and second circuit that switches the gate bias of the one of said transistors whose inherent junction is then forward poled.

5. The arrangement of claim 4 further comprising current sensing means providing to said control means a signal representative of the magnitude of load current and said control means adapted to produce a current interruption command responsive to an excessive magnitude of load current.

6. An arrangement responsive to a current interruption command for rapidly interrupting the flow of load current to an electric load notwithstanding the direction of load current at the occurrence of the current interruption command, comprising:

a. first and second separable contact means;

b. first and second field effect transistors having source, drain and gate electrodes;

c. a first branch circuit comprising said first contact means connected serially with the source electrode of the first of the transistors;

d. second branch circuit comprising said second contact means connected serially with the drain electrode of the second of the transistors;

e. current diversion means for temporarily diverting load current;

f. said first and second branch circuits and said current diversion circuits being connected in parallel circuit with terminal means adapted for connection intermediate a source of alternating current and an electric load;

g. control means having outputs connected in circuit with the gate electrodes of the first and second transistors and being responsive to a current interruption command to sequentially transfer load current from one to another of said branch circuits and to the current diversion means and to sequentially open one and the other of said separable contact means.

7. The arrangement of claim 6 wherein said field effect transistors are of the type having a single inherent junction such that signals applied to their gate electrode can only cut off current flowing in one, but not the other, direction between source and drain electrodes, said control means further comprising:

a. first means responsive to a current interruption command to increase the potential between the drain and source electrodes of the one of the first and second transistors whose inherent junction is forward poled so as to transfer load current from that one of said branch circuits that contains the one of the transistors to the other of said branch circuits and to thereupon open the separable contact means of that one of the branch circuits;

b. second means to cut off the other of said first and second transistors whose junction is reverse poled so as to transfer load current from the other of the branch circuits to the current diversion means and to thereupon open the separable contact means of the other of said branch circuits.

* * * * *

UNITED STATES PATENT AND TRADEMARK OFFICE

CERTIFICATE OF CORRECTION

PATENT NO. : 5,164,872

DATED : November 17, 1992

INVENTOR(S) : Edward K. Howell

It is certified that error appears in the above-identified patent and that said Letters Patent is hereby corrected as shown below:

In the Claims:

Column 15, line 44, delete "date" insert --gate--.
Column 16, line 29, delete "form" insert --from--.
Column 17, line 8, delete "last" insert --least--.

Signed and Sealed this

Fifth Day of October, 1993

*Attest:*

Bruce Lehman

BRUCE LEHMAN

*Attesting Officer*

*Commissioner of Patents and Trademarks*